US006510899B1

(12) United States Patent
Sheiretov et al.

(10) Patent No.: US 6,510,899 B1
(45) Date of Patent: Jan. 28, 2003

(54) TIME-DELAYED CONNECTOR LATCH

(75) Inventors: Todor K. Sheiretov, Sugar Land, TX (US); Roger A. Post, Houston, TX (US); Robert Ian Robson, Houston, TX (US); Joseph F. Cordera, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/681,202

(22) Filed: Feb. 21, 2001

(51) Int. Cl.[7] ..... E21B 34/10
(52) U.S. Cl. ..... 166/381; 166/65.1
(58) Field of Search ..... 166/381, 66.1, 166/66, 383, 380

(56) References Cited

U.S. PATENT DOCUMENTS 4,700,778 A 10/1987 Smith et al.
4,799,546 A 1/1989 Hensley et al.
5,058,683 A 10/1991 Godfrey et al.
5,158,142 A 10/1992 Miszewski et al.
5,568,836 A * 10/1996 Reid ..... 166/65.1
5,820,416 A * 10/1998 Carmichael ..... 439/668
5,871,052 A * 2/1999 Benson et al. ..... 166/386
5,967,816 A 10/1999 Sampa et al.
6,209,652 B1 * 4/2001 Portman et al. ..... 166/379

* cited by examiner

*Primary Examiner*—William Neuder
(74) *Attorney, Agent, or Firm*—Wayne I. Kanak; Brigitte L. Jeffery; John J. Ryberg

(57) ABSTRACT

A connector latch includes a housing body having an internal cavity, a grippable member slidably coupled to the housing body, and a hydraulic mechanism on the housing body for delaying sliding of the housing body relative to the grippable member when an external force is applied to the housing body.

40 Claims, 6 Drawing Sheets

TIME-DELAYED CONNECTOR LATCH

BACKGROUND OF INVENTION

The invention relates to methods and apparatus for making electrical connections in remote locations, e.g., inside an oil well. More specifically, the invention relates to a mechanical latch for connecting two mating parts of an electrical connector.

When a well is drilled, it is common to survey, or "log," certain sections of the well. Well logging involves obtaining and recording data related to one or more characteristics of the formations penetrated by the well. Many types of logs, e.g. mechanical, acoustic, electric, and radioactivity, can be made using appropriate logging tools. In wireline logging, the logging tools are deployed into the well by means of an armored electrical cable, or wireline, wound on the drum of a winch. The logging tools make measurements at selected depths of the well and send signals to a logging unit at the earth's surface through the cable. With the aid of gravity, the logging tools can be lowered into vertical wells by simply unwinding the cable from the winch drum. In horizontal or highly-deviated wells, however, gravity is frequently insufficient to move the logging tools to the depths to be logged. In these situations, it is sometimes necessary to push the logging tools along the well with drill pipe, coiled tubing or the like.

Wireline logging with drill pipe is complicated by the presence of the cable. It is cumbersome and dangerous to string the cable through all of the drill pipe before lowering the logging tool into the well. Some deployment systems have therefore been developed, such as one offered under the trade name Tough Logging Conditions System (TLCS) by Schlumberger Technology Corporation, Houston, Tex., which allow an electrical connection to be made between the logging tool and the cable after the logging tool has been lowered to the desired depth in the well. In these deployment systems, the logging tool is deployed with standard drill pipe. Then, the cable is run through the drill pipe and connected to the logging tool. After logging, the cable is detached from the logging tool and removed before the logging tool is retrieved.

In the TLCS and other deployment systems, the cable is remotely connected to the logging tool using a downhole connector. One mating part of the connector is mounted inside a docking head, which is attached to the logging tool. The logging tool is then lowered into the well on drill pipe. The other mating part of the connector is mounted in a pump-down head, which is attached to the end of the cable. The pump-down head is forced down the drill pipe with a flow of fluid, such as drilling mud, that circulates out of holes at the bottom of the drill pipe and into the well. An electrical connection is established when the mating parts come in contact. This connection is typically referred to as a "wet connection" because it is made in the flow of fluid, which is often conductive and challenges the reliability of the electrical connection. A mechanical latch joins the mating parts together and maintains the integrity of the joint during the logging operation. In most systems, the latching is established using the kinetic energy of the pump-down head that is pushed down by the circulating fluid. At the completion of the logging operation, the pump-down connector head is unlatched from the docking head, allowing the cable to be pulled out of the drill pipe. The pump-down head is usually unlatched from the docking head by pulling on the cable with a predetermined amount of tension.

In deeper wells, it becomes more difficult to meet all functional requirements for the mechanical latch. In particular, existing wet connector latch mechanisms do not meet two conflicting requirements for the strength of the mechanical latch. On one hand, the tensile force available for unlatching at the pump-down head diminishes quickly with depth and well curvature due to friction between the cable and the drill pipe and the weight of the cable itself. Thus, a weak latch that can be easily released is required under these conditions. On the other hand, pushing the pipe down into a deep and/or highly-deviated well is often characterized by stick and slip motion of the drill pipe. This uneven motion creates very short-lived, but high-amplitude, forces on the mechanical latch because the pipe motion and cable motion do not correspond. In order to avoid accidental unlatching due to these forces, the latch has to be strong.

Mechanical latches for downhole wet connectors have been disclosed and are commercially available. U.S. Pat. No. 5,967,816 issued to Sampa et al. discloses a latch mechanism which includes a three-finger latch collet and a latch ring. The latch collet is attached to the docking head, while the latch ring is part of the pump-down head. During latching, the latch ring forces the fingers open and passes through the collet. The fingers then close behind the ring, preventing the pump-down head from separating from the docking head. The unlatching is conducted by applying tension to the logging cable. When this force is strong enough to exceed the yield strength of the ring material at the points of contact, the fingers break loose, destroying a portion of the ring. The mechanism has the advantages of simplicity and reliability and has been very successful commercially. In addition, its release forces are highly predictable. Different levels of force can be achieved by varying the strength of the latch ring. However, the number of latch/unlatch cycles is limited because the ring suffers substantial damage every time it is unlatched. Further, the unlatching force is constant and cannot be adjusted once the latch is downhole. Hence this mechanism reaches the limit of its usefulness at a certain well depth.

U.S. Pat. No. 4,799,546 issued to Hensley et al. and U.S. Pat. No. 4,700,778 issued to Smith et al. disclose latch mechanisms based on J-shaped slots, or J-slots. These latch mechanisms typically include protrusions on one mating part of the connector and J-slots cut in the other mating part of the connector. One mating part of the connector is attached to the pump-down head, while the other mating part is mounted in the docking head. During latching, the protrusions engage the J-slots and then slide along them, forcing the pump-down head to rotate a predetermined amount. At the end of the travel, a spring pushes back the mating part containing the protrusions. The shape of the J-slots prevent the protrusions from traveling back along the same path. Instead, the protrusions are forced towards a different section of the J-slot, thus locking the two mating parts of the connector together. The protrusions can be separated from the J-slots by either tensioning and slackening of the cable or by pushing the pump-down head down. This forces the protrusions to travel along a third section of the J-slot, which frees the protrusions from the J-slots and allows the pump-down head to be separated from the docking head. The advantage of the J-slot system is that it allows multiple latch/unlatch cycles. Another advantage is that no elements of the system are destroyed, and there is no risk of leaving debris in the well. The system is relatively complex, however, and there is a higher risk of accidentally unlatching due to an unintended pull on the cable caused, for example, by stick-slip motion of the drill pipe.

U.S. Pat. No. 5,058,683 issued to Godfrey et al. discloses a J-slot latch mechanism that has reduced risk of accidental unlatching. In this mechanism, the shape of the J-slot is modified such that multiple tensioning and slackening cycles on the cable are required before the latch is released. This mechanism, however, does not completely eliminate the occurrence of an accidental unlatch. The Godfrey et al. patent also discloses an electrically activated wet connector latch which uses electromagnetic devices to create the force holding the two mating parts of the wet connector together. This connector has many potential advantages, the most important of which is that the latch can be controlled remotely. However, this latch mechanism has not received wide commercial acceptance due to its complexity, difficulties with downhole power supplies, and safety concerns, especially when the tool string contains perforating guns.

U.S. Pat. No. 5,158,142 issued to Miszewski et al. discloses an apparatus for releasing a pipe string from an object stuck downhole. This apparatus uses a hydraulic time-delay mechanism that selectively releases only when a predetermined tension is applied to the pipe string for a predetermined amount of time. This mechanism does not release under accidental high tensile loads, such as those that may result from shooting perforating guns. However, the mechanism releases when a much smaller tensile force is applied for much longer periods of time. This mechanism is not suitable for wet connectors because it cannot latch, it only releases. Hence, it can only be used once, and the mechanical connection has to be established in some other way.

Therefore, what is needed is a latch mechanism for electrical connectors which can be easily released, does not accidentally unlatch, and has multiple latch/unlatch cycles.

SUMMARY OF INVENTION

In one aspect, the invention relates to a connector latch which comprises a housing body having an internal cavity, a grippable member slidably coupled to the housing body, and a hydraulic mechanism on the housing body for delaying sliding of the housing body relative to the grippable member when an external force is applied to the housing body.

In another aspect, the invention relates to a connector latch which comprises a housing body having an internal cavity, a grippable member slidably coupled to the housing body, a gripping member for selectively engaging the grippable member, and a hydraulic mechanism on the housing body for delaying sliding of the housing body relative to the grippable member when an external force is applied to the housing body.

In another aspect, the invention relates to a connector latch which comprises a housing body having an internal cavity, a grippable member slidably coupled to the housing body, a sealed chamber defined within the internal cavity, the sealed chamber having a volume which varies with relative movement between the housing body and the grippable member, and a flow restriction for controllably releasing fluid from the sealed chamber to the internal cavity as the volume of the sealed chamber decreases.

In another aspect, the invention relates to a mechanical latch for connecting two mating parts of an electrical connector which comprises a housing body having an internal cavity, a grippable member slidably coupled to the housing body and attached to one of the mating parts, a gripping member adapted to selectively engage the grippable member and attached to the other mating part, and a hydraulic mechanism on the housing body for delaying movement of the housing body relative to the grippable member when an external force is applied to the housing body.

In another aspect, the invention relates to a method for connecting and selectively disconnecting a gripping member. The method comprises lowering a tool comprising a grippable member to the gripping member, bringing the grippable member in contact with the gripping member, pushing the gripping member against the grippable member until the gripping member engages the grippable member, and applying a tension to the tool for a duration determined by a hydraulic time-delay mechanism in the tool, and moving the tool relative to the gripping member to release the grippable member.

Other aspects and advantages of the invention will be apparent from the following description and the appended claims.

DETAILED DESCRIPTION

Embodiments of the invention provide a wet connector latch for mechanically joining two mating parts. In general, the invention includes a latch collet, an inner and outer body, a pre-load spring, and a hydraulic time-delay system. The latch collet is attached to one of the mating parts, while all other elements of the wet connector latch are attached to the other mating part. The latch collet and the inner body engage to provide a mechanical latch between the two mating parts. The time-delay system comprises a fluid-filled chamber and means for controllably releasing fluid from the chamber. To separate the mating parts, a force is applied to the outer body. If the force is larger than the force necessary to compress the spring, the outer body starts to slide relative to the inner latch body. This movement reduces the volume of the chamber and causes the pressure of the fluid inside the chamber to increase. The pressurized fluid is slowly squeezed out through components of the time-delay system. The time-delay system ensures that the latch does not release unless a force with a predetermined magnitude is applied for a predetermined amount of time. As the outer body travels a predetermined distance with respect to the inner body, it engages the latch collet and forces the latch collet to release the inner body. At this point, the mechanical coupling between the two mating parts is released.

Figure 1A:
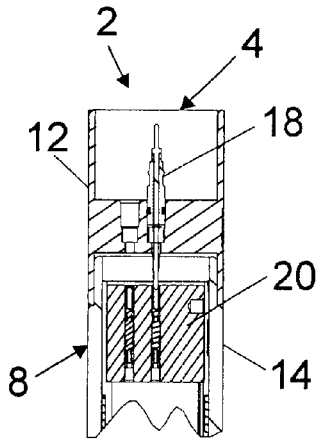
FIGS. 1A–1D show a cross-section of a wet connector latch according to one embodiment of the invention.
Figure 1B:
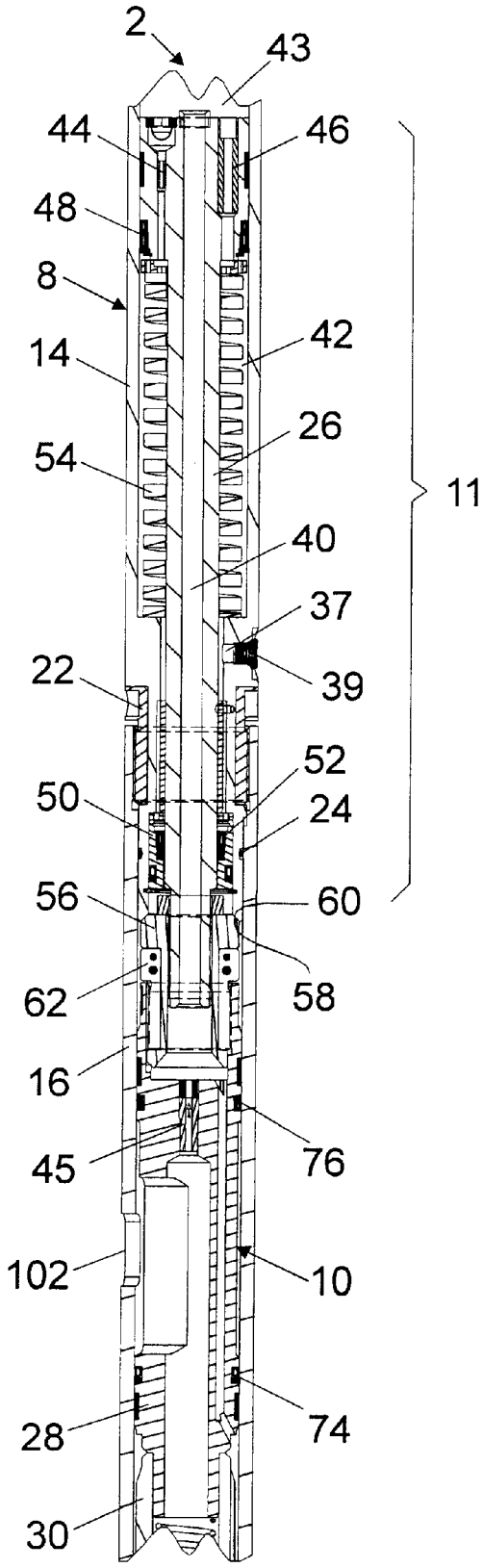
Figure 1C:
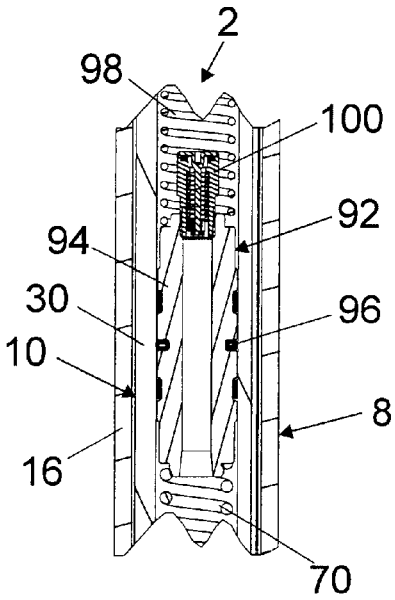
Figure 1D:
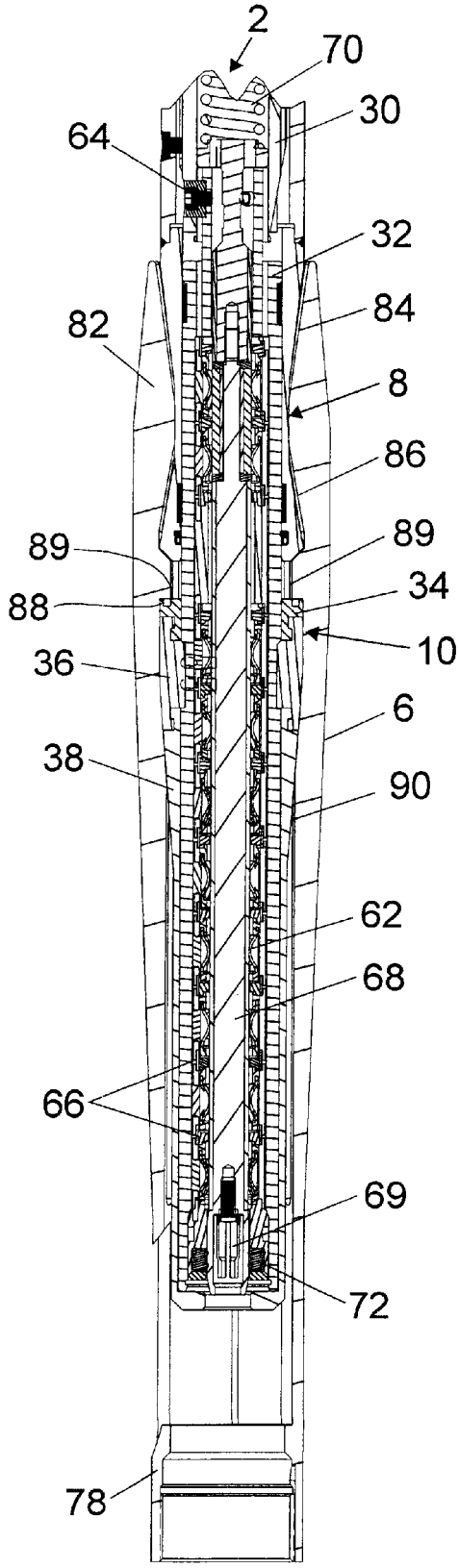

Various embodiments of the invention will now be described with reference to the accompanying drawings. FIG. 1A shows a partial cross-sectional view of a wet connector latch, generally indicated by reference numeral 2, according to one embodiment of the invention. FIG. 1B is a continuation of the drawing of FIG. 1A, FIG. 1C is a continuation of the drawing of FIG. 1B, and FIG. 1D is a continuation of the drawing of FIG. 1C. The wet connector latch 2 comprises a pump-down head 4 and a latch collet (6 in FIG. 1D). The pump-down head 4 includes an outer latch body 8 and an inner latch body (10 in FIG. 1B). The outer latch body 8 and the inner latch body (10 in FIG. 1B) enclose the elements of a time-delay system, generally indicated by reference numeral 11 in FIG. 1B.

Referring to FIG. 1A, the outer latch body 8 includes an upper head 12, a pressure chamber body 14, and an outer housing weldment (16 in FIG. 1B). The upper head 12 includes a feedthrough 18. The upper head 12 is attached to the upper end of the pressure chamber body 14. A bulkhead connector 20 is mounted at the upper end of the pressure chamber body 14. The bulkhead connector 20 and the feedthrough 18 allow electrical connection between the wires (not shown) inside the pump-down head 4 and an external cable (not shown). As shown in FIG. 1B, the lower end of the pressure chamber body 14 is connected to the outer housing weldment 16 by a threaded ring 22. Static seal 24 prevents fluid from entering this joint.

Still referring to FIG. 1B, the inner latch body 10 includes a piston 26, a mud/oil crossover 28, a wire mandrel 30, a female connector housing (32 in FIG. 1D), a latch ring (34 in FIG. 1D), a clamp (36 in FIG. 1D), and a protective sleeve (38 in FIG. 1D). The piston 26 is located within the pressure chamber body 14 and is movable relative to the pressure chamber body 14. A chamber 42 is defined between the piston 26 and the pressure chamber body 14. The piston 26 carries a hydraulic restriction 44, such as an orifice, a check valve 46, and a dynamic seal 48. A seal cartridge 50 is mounted at the lower end of the pressure chamber body 14. The seal cartridge 50 holds dynamic seals 52. The dynamic seals 48, 52 isolate the chamber 42 from the rest of the internal volume of the pump-down head 4. The chamber 42 is filled with a substantially incompressible fluid, typically oil. The pressure chamber body 14 preferably includes a port 37 through which fluid can be supplied to the chamber 42. The port 37 is sealed with a plug 39 when not in use.

The piston 26 has a bore 40 through which fluid can be communicated to a space 43 above the chamber 42. Fluid in the space 43 can flow into the chamber 42 through the check valve 46. A pre-load spring 54 is located inside the chamber 42. When the spring 54 is compressed, fluid is squeezed out of the chamber 42 through the hydraulic restriction 44. The fluid-filled, sealed chamber 42 and the hydraulic restriction 44 form part of the time-delay system 11. Another element of the time-delay system 11 is a flooding valve 45 located in the mud/oil crossover 28. The purpose of the flooding valve 45 will be explained later. The pre-load on the spring 54 can be adjusted by a nut 56 threaded to the lower end of the piston 26. The pre-load spring 54 exerts a force on a surface 58 of the nut 56, bringing the surface 58 against a surface 60 of the pressure chamber body 14. The force of the spring 54 is sufficient to prevent relative movement between the inner latch body 10 and the outer latch body 8 during latching. A threaded ring 62 connects the lower end of the piston 26 to the mud/oil crossover 28. The mud/oil crossover 28 is welded to the wire mandrel 30.

Referring to FIG. 1D, the wire mandrel 30 is connected to the female connector housing 32 by shear blocks 64. The female connector housing 32 carries female contacts 66. The female contacts 66 are connected to wires (not shown) that run along the pump-down head (4 in FIG. 1A). An insulating shuttle 68 is disposed in a cavity 62 in the female connector housing 32. The insulating shuttle 68 prevents any electrical communication between the female contacts 66. The shuttle 68 is biased downwardly by a spring 70, which causes an internal grip 69 of the shuttle 68 to engage a dynamic seal 72. The dynamic seal 72 and seals (74, 76 in FIG. 1B) isolate the internal volume of the pump-down head 4 from external fluid during latching and unlatching.

Figure 2:
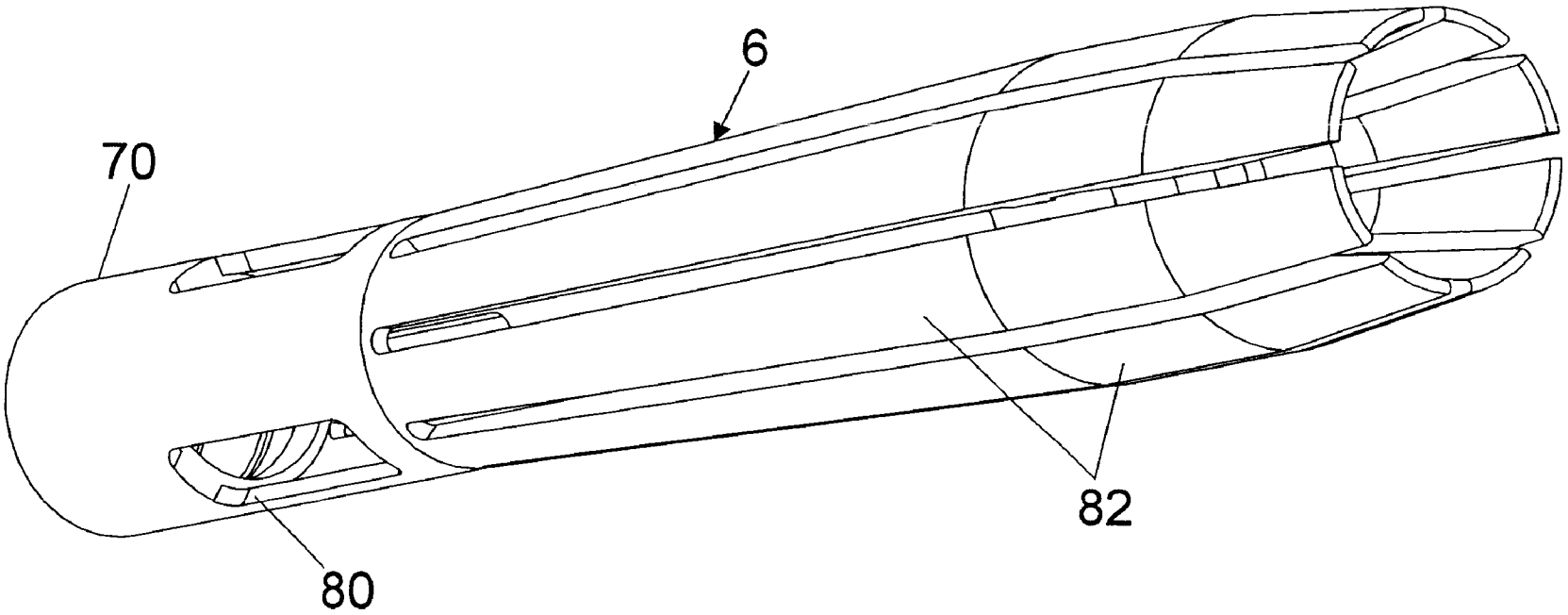
FIG. 2 is a three-dimensional view of the latch collet shown in FIG. 1D.

The protective sleeve 38 is mounted on the female connector housing 32. Attached to the upper end of the protective sleeve 38 is the clamp 36, which holds the latch ring 34. The latch ring 34, clamp 36, and protective sleeve 38 are the parts of the pump-down head 4 that are engaged by the latch collet 6 when the wet connector latch 2 is in the latched position. The latch collet 6 includes a base 78 with openings (80 in FIG. 2). The openings (80 in FIG. 2) are for circulating fluid flow out of the latch collet 6. Flexible latch fingers 82 (also shown in FIG. 2) are joined together at the base 78. The latch fingers 82 are shaped so as to form a latching surface 84, an unlatching surface 86, and a holding surface 88. During latching, the slanted surface 90 of the protective sleeve 38 slides against the latching surface 84 and pushes the latch fingers 82 outward. This allows the pump-down head 4 to slide inside the latch collet 6 until the fingers 82 snap on the latch ring 34. In this position, the holding surface 88 is in contact with the recess 89 provided by the latch ring 34.

The latch ring 34 is preferably made from a material that forms a low friction pair with the material the latch fingers 82 are made from. During unlatching, there is sliding between the latch ring 34 and the latch fingers 82, which will generally result in a certain amount of wear on the latch ring 34 and latch fingers 82. The material of the latch ring 34 is preferably a softer material than the material used in the latch fingers 82. In this way, the wear occurs primarily on the surface of the latch ring 34, which extends the life of the latch collet 6. In this configuration, the latch ring 34 is essentially the sacrificial part and is replaced after a predetermined number of latch/unlatch cycles. The protective sleeve 38 and clamp 36 can be dismounted from the female connector housing 32 to facilitate easy replacement of the latch ring 34.

Referring to FIG. 1C, the pump-down head 4 includes a pressure compensating system, generally indicated by reference numeral 92. In the illustrated embodiment, the pressure compensating system 92 includes a piston 94, seal 96, spring 98, and pressure relief valve 100. The piston 94 can move inside the wire mandrel 30. The piston 94 separates the internal fluids of the pump-down head 4 from the external fluid which enters through opening (102 in FIG. 1B) of the mud/oil crossover (28 in FIG. 1B). The pressure compensating system 92 keeps the pressure of all fluid-filled internal volumes of the pump-down head 4 higher than ambient pressure. Similar pressure compensating systems are widely used in all fluid-filled downhole devices.

The pressure compensating system 92 also supplies extra fluid required for unlatching. During unlatching, the inner latch body 10 is pulled out of the outer latch body 8, thus increasing the internal volume of the pump-down head 4. Because the amount of fluid in the pump-down head 4 cannot change, a redistribution of the fluid inside the pump-down head 4 must occur. During unlatching, oil flows from the pressure compensating system 26 through the mud/oil crossover (28 in FIG. 1B) and the piston bore (40 in FIG. 1B) to the chamber (42 in FIG. 1B). If the pump-down head 4 inadvertently loses much of its internal fluid during unlatching, a hydraulic lock-up may occur which may make it impossible to unlatch. To prevent this situation, the flooding valve (45 in FIG. 1B) allows external fluid to flow into the pump-down head 4 if the external pressure becomes higher than the internal pressure.

Figure 3A:
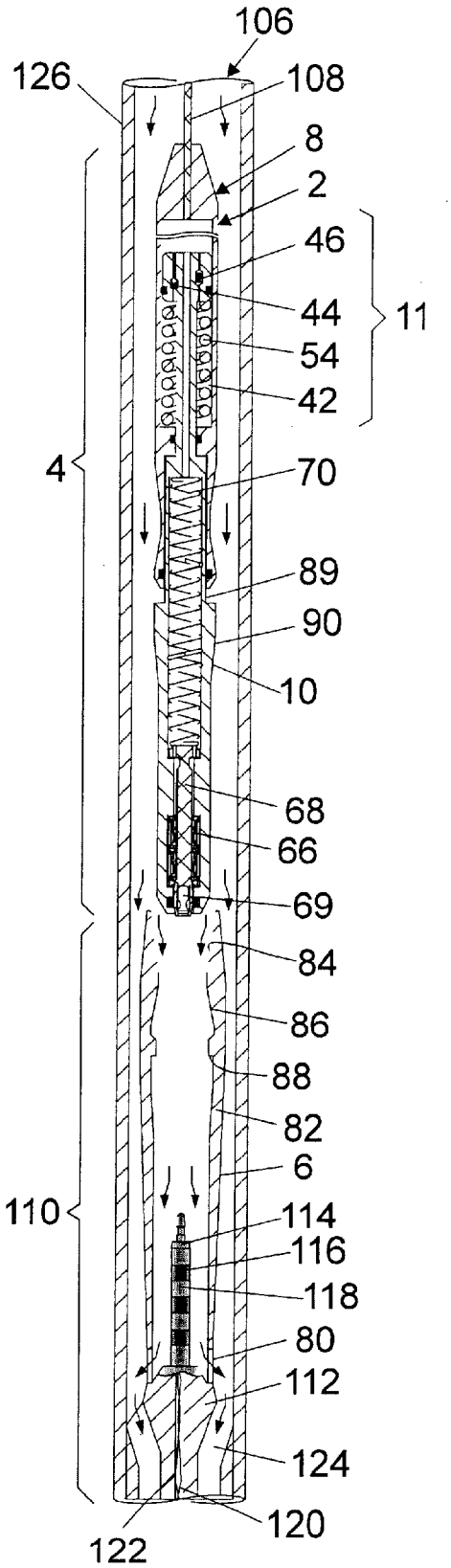
FIG. 3A shows the wet connector latch prior to latching.

FIG. 3A shows a logging system 106 incorporating the wet connector latch (2 in FIGS. 1A–1D). It should be noted that several details of the logging system 106, such as the logging unit and logging tools, are omitted for clarity of the illustration. The wet connector latch 2 is shown in the unlatched position, with the pump-down head 4 attached to a cable 108 that runs to the surface, and shows the latch collet 6 coupled to a docking head 110. It should be noted that for the sake of simplicity, some of the elements of the pump-down head 4 shown in FIGS. 1A–1D are omitted in this drawing. Also, the outer latch body 8 and the inner latch body 10 are shown as single solid pieces.

The female contacts 66 are connected to insulated electrical conductors in the cable 108 by wires (not shown) that run inside the pump-down head 4. The latch collet 6 is attached to the upper body 112 of the docking head 110. The docking head 110 includes a male wet connector contact assembly 114, which consists of alternating electrically conductive rings or contacts 116 and insulating rings 118. The conductive rings 116 are attached to wires 120 that run inside a passage 122 in the docking head body 112 and are connected to downhole logging tools (not shown). The docking head body 112 also has passages 124 for fluid flow. The docking head body 112 is rigidly attached to a drill pipe 126. The drill pipe 126 is generally located downhole in a well (not shown) during operation. The pump-down head 4 is pushed down the drill pipe 126 by a flow of fluid, as indicated by the arrows.

Figure 3B:
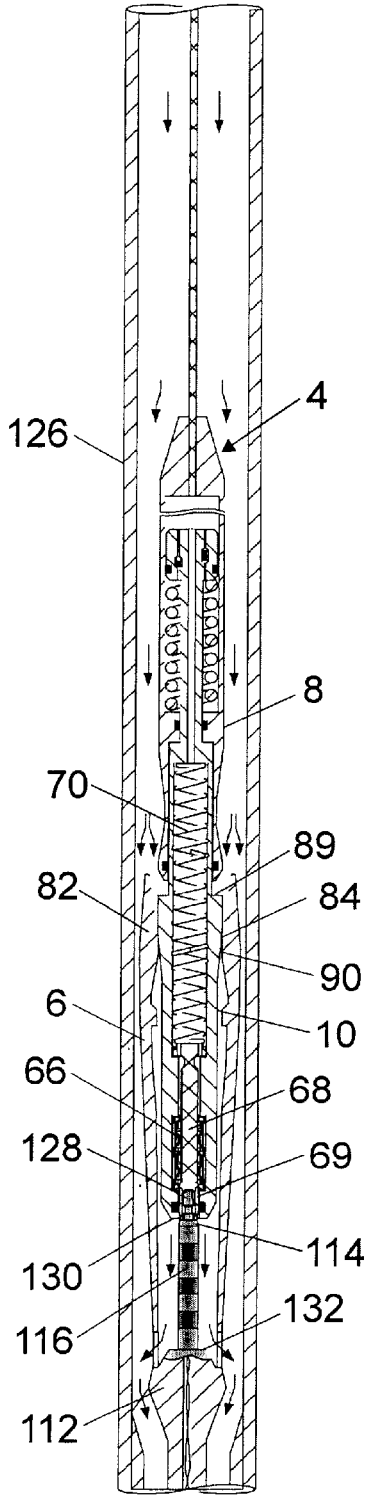
FIG. 3B shows the beginning phase of the wet connector latching process.

FIG. 3B shows the beginning phase of the latching process in which the internal grip 69 (also shown in FIG. 1D) of the insulating shuttle 68 has just engaged the tip 128 of the male contact wet connector assembly 114. At this time, the pump-down head 4 is still moving downward, pushed by the mud flow pumped down the drill pipe 126. The slanted surface 90 of the inner latch body 10 slides against the latch surface 84 of the latch collet 6 and pushes the flexible fingers 82 outward. This allows the pump-down head 4 to slide into the latch collet 6. It should be noted that there is no relative motion between the inner latch body 10 and the outer latch body 8 at this time. Also, it should be noted that surface 130 of the inner latch body 10 and surface 132 of the docking head body 112 are still far apart and that the downward motion of the pump-down head 4 continues.

Figure 3C:
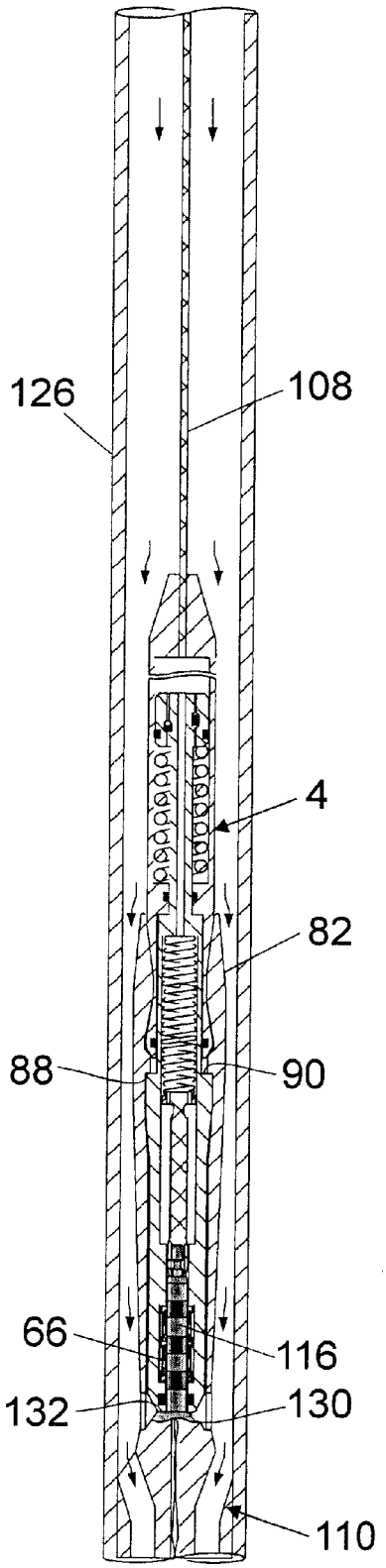
FIG. 3C shows the wet connector latch in the latched position.

As the pump-down head 4 continues to move downward, the male contact assembly 114 penetrates the pump-down head 4, pushing the insulating shuttle 68 inward. This in turn compresses the spring 70. The extra volume of fluid that is displaced by the movement of the insulating shuttle 68 is taken up by the pressure compensating system (92 in FIG. 1C). The downward motion of the pump-down head 4 stops when surface 130 of the inner latch body 10 contacts surface 132 of the docking head body 112. This position of the pump-down head 4 is shown in FIG. 3C. At the time this happens, the latch fingers 82 latch onto the latch ring (34 in FIG. 1D), and the holding surface 88 of the latch fingers 82 comes into contact with recess 89 in the inner latch body 10, preventing the separation of the surfaces 130, 132. In this way, relative motion between the female contacts 66 and male contacts 116 is prevented. In this position, latching of the pump-down head 4 and the docking head 110 is complete. The pump-down head 4 and docking head 110 remain in this position during the entire logging operation. It should be noted that flow of fluid can continue throughout the entire logging operation as needed. Thus, the invention does not interfere with the effective control of the well.

Figure 3D:
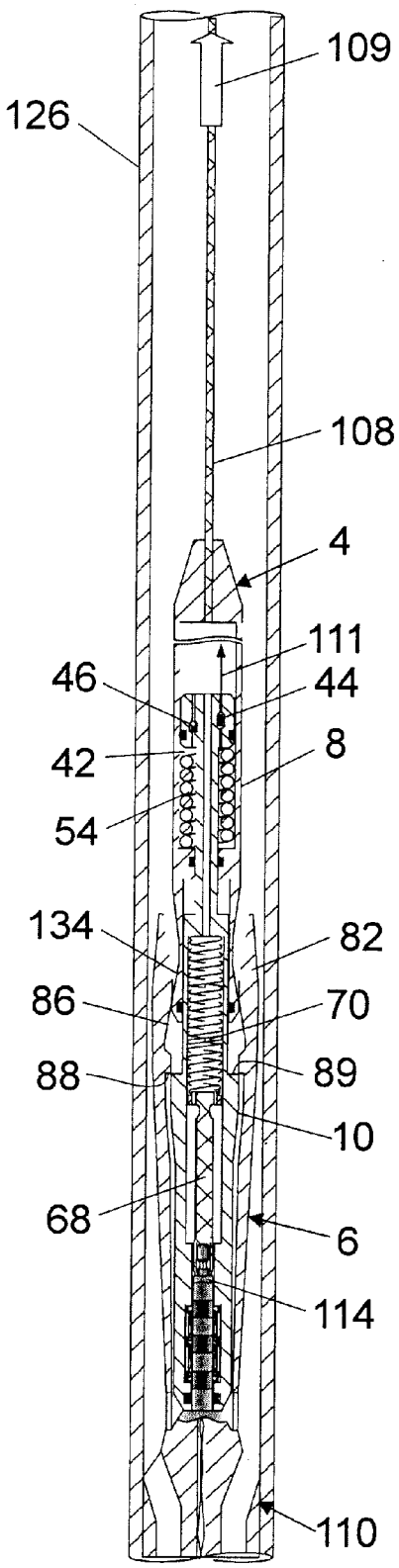
FIG. 3D shows the beginning phase of the wet connector unlatching process.
Figure 3E:
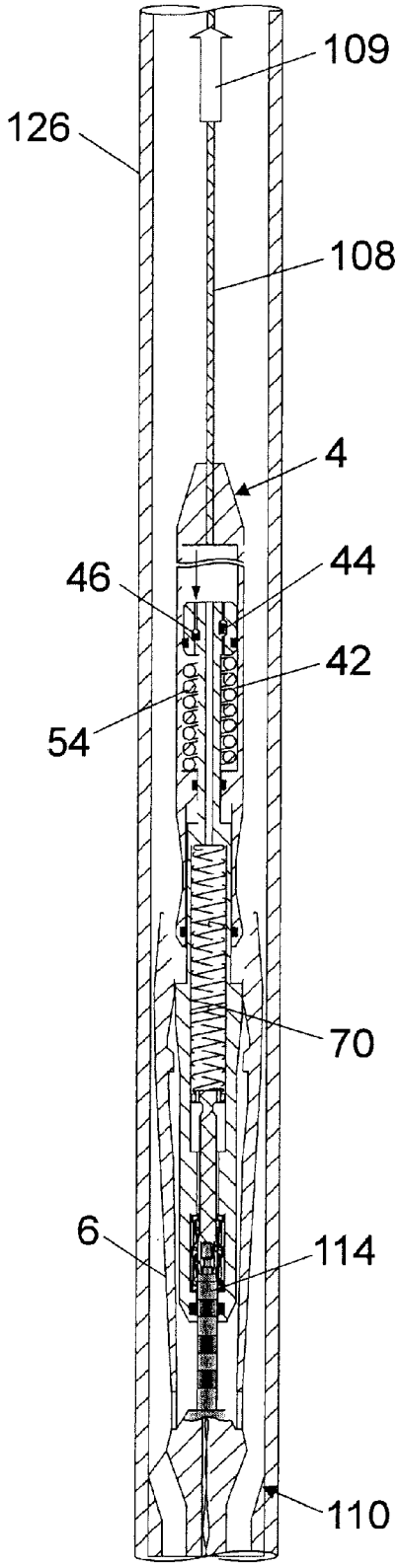
FIG. 3E shows the wet connector latch in an unlatched position.

FIG. 3D shows the beginning phase of the unlatching process. This process starts by applying an upward pull on the cable 108, indicated by the upward-pointing arrow 109. This force is transmitted from the cable 108 to the outer latch body 8. Since the inner latch body 10 is still held in place by the latch fingers 82, the external force applied to the outer latch body 8 will tend to cause the outer latch body 8 to start sliding with respect to the inner latch body 10 in the upward direction. This, however, can happen only if the external force is strong enough to overcome the initial pre-load of spring 54. Thus, the initial pre-load on spring 54 determines the minimum unlatch force.

Further, the relative motion between the inner latch body 10 and outer latch body 8 causes the volume of the chamber 42 to decrease. Because the chamber 42 is filled with substantially incompressible fluid, when the volume of the chamber 42 decreases, the fluid flows out of the chamber 42. Fluid can flow out of the chamber 42 only through the hydraulic restriction 44, however. In FIG. 3D, the flow through the hydraulic restriction 44 is indicated by the arrow 111. The hydraulic restriction 44 allows fluid to escape only at a relatively slow rate, thus creating a positive pressure differential between the chamber 42 and the rest of the pump-down head 4 internal volume. This pressure differential counteracts the tendency of the inner latch body 10 and outer latch body 8 to slide with respect to each other. If the force applied to the outer latch body 8 is high, but of short duration, the fluid will not have enough time to escape from the chamber 42. This causes a very high pressure differential. In this case, the external force is almost entirely balanced by the pressure increase in chamber 42. On the other hand, if the external force is applied for an extended period of time, the fluid will have sufficient time to escape from the chamber 42, and the pressure differential caused by the hydraulic restriction 44 will be much lower.

The force required to move the outer latch body 8 with respect to the inner latch body 10 determines the strength of the mechanical latch. From the above discussion, it is clear that this strength will be variable and will depend on the characteristics of the force applied through the cable 108 and on the flow restriction provided by the hydraulic restriction 44. By appropriately designing the hydraulic restriction 44, it is possible to obtain a variety of latch strength levels that are suited for any specific downhole conditions.

Referring to FIG. 3D, as the outer latch body 8 slides with respect to the inner latch body 10, surface 134 of the outer latch body 8 engages the unlatching surface 86 of the latch fingers 82. This causes the latch fingers 82 to spread out. As the latch fingers 82 move in the outward direction, the holding surface 88 of the latch fingers 82 starts to disengage from the recess 89 of the inner latch body 8. When the fingers 82 move far enough, they no longer hold the inner latch body 8 in place, and the coupling between the pump-down head 4and the docking head 110 is released. Because there is still a tension 109 on the cable 108, the pump-down head 4 is moved out of the latch collet 6.

It should be noted that as the pump-down head 4 and the docking head 110 are pulled apart, the male contact assembly 114 is pulled out of the pump-down head 4. At the same time, spring 70 pushes the insulating shuttle 68 downward, back to its original position in the pump-down head 4. After the pump-down head 4 is released by the latch collet 6, there is no force counteracting the elastic energy built up in spring 54. The spring 54 is now free to expand, and in doing so, pulls the inner latch body 10 back into the outer latch body 8. This action tends to enlarge the chamber 42. Fluid flows into the chamber 42 through the check valve 46. By the time the pump-down head 4 is pulled out of the latch collet 6, the outer latch body 8 has already moved to its original location. At this time, the latching/unlatching cycle is completed, and the pump-down head 4 and docking head 110 are back in the position shown in FIG. 3A, ready for another latching if necessary.

Now consider how the invention will react to transient forces that may result from the stick-slip motion of the drill pipe 126. In this case, a very strong tensile force will be applied to the outer latch body 8. This tensile force is created because the motion of the drill pipe 126 does not correspond to the motion of the cable 108. As explained earlier, this force will cause a pressure increase in chamber 42. In response to the pressure increase, fluid will start flowing out of the chamber 42, and the outer latch body 8 will start moving with respect to the inner latch body 10. So far, these events are similar to those of the unlatching process. The main difference is that the force caused by stick-slip motion of the drill pipe 126 is of very short duration. Since the unlatching takes a relatively long time, this force will typically be relieved before the unlatching can be completed. Once the external force is gone, there is nothing to balance the compression of spring 54, and the spring 54 will quickly bring the outer latch body 8 back to the position indicated in FIG. 3C. Thus, the system quickly resets once the external force is removed. Consequently, the invention can withstand an unlimited number of transient tension events without unlatching.

The invention may provide several general advantages. As discussed above, the wet connector latch of the present invention allows a joint to be formed mechanically between two mating parts of a tool string. This joint can be selectively uncoupled when necessary. The wet connector latch is particularly suited for mechanically joining two parts of a downhole wet connector used for drill-pipe conveyed logging. An important characteristic of the wet connector latch is that it releases only when a predetermined force is applied to it for a predetermined amount of time. Another important characteristic of the wet connector latch is that it can be operated multiple times.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A connector latch, comprising:

a housing body having an internal cavity;

a grippable member slidably coupled to the housing body; and a hydraulic mechanism on the housing body for delaying sliding of the housing body relative to the grippable member when an external force is applied to the housing body, wherein the hydraulic mechanism comprises a sealed chamber defined within the internal cavity, the sealed chamber having a volume which varies with relative movement between the housing body and the grippable member, and further comprises a flow restriction for controllably releasing fluid from the sealed chamber to the internal cavity as the volume of the sealed chamber decreases and a valve for supplying fluid from the internal cavity to the sealed chamber as the volume of the chamber increases.

2. The connector latch of claim 1, wherein the hydraulic mechanism further comprises a flooding valve for communicating external fluid pressure into the internal cavity when the pressure in the internal cavity is lower than the external fluid pressure.

3. The connector latch of claim 1, further comprising a pressure compensator for balancing pressure between the internal cavity and the exterior of the housing body.

4. The connector latch of claim 1, wherein the grippable member comprises a recess for engagement with a holding surface on a gripping member.

5. The connector latch of claim 4, wherein the recess comprises a circumferential ring mounted on the grippable member.

6. The connector latch of claim 5, wherein the circumferential ring is made of a softer material than the holding surface.

7. The connector latch of claim 4, wherein the gripping member comprises a collet.

8. The connector of claim 7, wherein the grippable member comprises a slanted surface which is displaced along the collet upon relative movement between the housing body and the grippable member.

9. A connector latch, comprising:

a housing body having an internal cavity;

a grippable member slidably coupled to the housing body;

a spring which biases a surface on the housing body against an opposing surface on the grippable member, wherein the housing body is urged to move relative to the grippable member when the external force exceeds a pre-load on the spring; and a hydraulic mechanism on the housing body for delaying sliding of the housing body relative to the grippable member when an external force is applied to the housing body.

10. The connector latch of claim 9, further comprising means for adjusting the pre-load on the spring.

11. A connector latch, comprising:

a housing body having an internal cavity;

a grippable member slidably coupled to the housing body; and a hydraulic mechanism on the housing body for delaying sliding of the housing body relative to the grippable member when an external force is applied to the housing body, wherein the grippable member comprises a female connector housing having at least one female electrical contact.

12. The connector latch of claim 11, further comprising a shuttle movably disposed in a cavity in the female connector housing, the shuttle having a gripping member for engaging a tip of a male electrical connector.

13. The connector latch of claim 12, wherein the shuttle is spring-loaded against a surface on the grippable member.

14. The connector latch of claim 12, further comprising a seal mounted between the female connector housing and the shuttle.

15. A connector latch, comprising:

a housing body having an internal cavity;

a grippable member slidably coupled to the housing body;

a gripping member for selectively engaging the grippable member;

a hydraulic mechanism on the housing body for delaying sliding of the housing body relative to the grippable member when an external force is applied to the housing body; and a spring which biases a surface on the housing body against an opposing surface on the grippable member, wherein the housing body is urged to move relative to the grippable member when the external force exceeds a pre-load on the spring.

16. The connector latch of claim 15, wherein the hydraulic mechanism comprises a sealed chamber defined within the internal cavity, the sealed chamber having a volume which varies with relative movement between the housing body and the grippable member.

17. The connector latch of claim 16, wherein the hydraulic mechanism further comprises a flow restriction for controllably releasing fluid from the sealed chamber to the internal cavity as the volume of the sealed chamber decreases.

18. A connector latch, comprising:

a housing body having an internal cavity;

a grippable member slidably coupled to the housing body;

a gripping member for selectively engaging the grippable member; and a hydraulic mechanism on the housing body for delaying sliding of the housing body relative to the grippable member when an external force is applied to the housing body, wherein the grippable member comprises a recess for engagement with a holding surface on the gripping member.

19. The connector latch of claim 18, wherein the gripping member comprises a collet.

20. The connector of claim 19, wherein the grippable member comprises a slanted surface which is displaced along the collet upon relative movement between the housing body and the grippable member.

21. A connector latch, comprising:

a housing body having an internal cavity;

a grippable member slidably coupled to the housing body;

a sealed chamber defined within the internal cavity, the sealed chamber having a volume which varies with relative movement between the housing body and the grippable member;

a flow restriction for controllably releasing fluid from the sealed chamber to the internal cavity as the volume of the sealed chamber decreases; and a spring which biases a surface on the housing body against an opposing surface on the grippable member, wherein the housing body is urged to move relative to the grippable member when an external force applied to the housing body exceeds a pre-load on the spring.

22. A mechanical latch for connecting two mating parts of an electrical connector, comprising:

a housing body having an internal cavity;

a grippable member slidably coupled to the housing body and attached to one of the mating parts;

a gripping member adapted to selectively engage the grippable member and attached to the other mating part; and a hydraulic mechanism on the housing body for delaying movement of the housing body relative to the grippable member when an external force is applied to the housing body; and wherein the mating parts engage to form an electrical connection.

23. The mechanical latch of claim 22, wherein one of the mating parts comprises a female connector housing having at least one female contact.

24. The mechanical latch of claim 23, wherein the other mating part comprises a male connector having at least one male contact for engagement with the female contact.

25. The mechanical latch of claim 24, wherein a shuttle is movably disposed in a cavity in the female connector housing, the shuttle having a surface for engaging a tip of the male connector.

26. The mechanical latch of claim 22, wherein the hydraulic mechanism comprises a sealed chamber defined within the internal cavity, the sealed chamber having a volume which varies with relative movement between the housing body and the grippable member.

27. The mechanical latch of claim 26, wherein the hydraulic mechanism further comprises a flow restriction for controllably releasing fluid from the sealed chamber to the internal cavity as the volume of the sealed chamber decreases.

28. The mechanical latch of claim 27, wherein the hydraulic mechanism further comprises a valve for supplying fluid from the internal cavity to the sealed chamber as the volume of the chamber increases.

29. The mechanical latch of claim 28, wherein the hydraulic mechanism further comprises a flooding valve for communicating external fluid pressure into the internal cavity when the pressure in the internal cavity is lower than the external fluid pressure.

30. The mechanical latch of claim 22, further comprising a pressure compensator for balancing pressure between the internal cavity and the exterior of the housing body.

31. The mechanical latch of claim 22, further comprising a spring which biases a surface on the housing body against an opposing surface on the grippable member, wherein the housing body is urged to move relative to the grippable member when the external force exceeds a pre-load on the spring.

32. The mechanical latch of claim 22, wherein the grippable member comprises a recess for engagement with a holding surface on the gripping member.

33. The mechanical latch of claim 32, wherein the recess comprises a circumferential ring mounted on the grippable member.

34. The mechanical latch of claim 33, wherein the circumferential ring is made of a softer material than the holding surface.

35. The mechanical latch of claim 22, wherein the gripping member comprises a collet.

36. A method for connecting and selectively disconnecting a gripping member, comprising:

lowering a tool comprising a grippable member to the gripping member;

bringing the grippable member in contact with the gripping member;

pushing the gripping member against the grippable member until the gripping member engages the grippable member;

applying a tension to the tool for a duration determined by a hydraulic time-delay mechanism in the tool; and moving the tool relative to the gripping member to release the grippable member.

37. The method of claim 36, wherein the gripping member is located downhole in a well.

38. The method of claim 36, wherein the tool is lowered on the end of an electrical cable.

39. The method of claim 38, wherein lowering the tool comprises pumping the tool along a well in a flowing fluid.

40. The method of claim 38, wherein the grippable member includes at least one female contact.

* * * * *